US011735357B2

(12) United States Patent
Raju

(10) Patent No.: US 11,735,357 B2
(45) Date of Patent: Aug. 22, 2023

(54) TRANSFORMER WITH IMPROVED INSULATION STRUCTURE

(71) Applicant: Ravisekhar Nadimpalli Raju, Clifton Park, NY (US)

(72) Inventor: Ravisekhar Nadimpalli Raju, Clifton Park, NY (US)

( * ) Notice: Subject to any disclaimer, the term of this patent is extended or adjusted under 35 U.S.C. 154(b) by 287 days.

(21) Appl. No.: 17/156,959

(22) Filed: Jan. 25, 2021

(65) Prior Publication Data

US 2021/0375533 A1 Dec. 2, 2021

Related U.S. Application Data

(60) Provisional application No. 62/964,713, filed on Jan. 23, 2020.

(51) Int. Cl.
*H01F 27/32* (2006.01)

(52) U.S. Cl.
CPC ..... *H01F 27/324* (2013.01)

(58) Field of Classification Search
CPC ..... H01F 27/324; H01F 2027/2819; H01F 2027/348; H01F 27/2804
See application file for complete search history.

(56) References Cited

U.S. PATENT DOCUMENTS

2015/0228398 A1* 8/2015 Moiseev ..... H01F 27/2823 361/139
2020/0135379 A1* 4/2020 Lu ..... H01F 27/306
2020/0191852 A1* 6/2020 Handy ..... H01F 27/363
2020/0243253 A1* 7/2020 Ma ..... H01F 27/29
2020/0251278 A1* 8/2020 Zhang ..... H01F 38/42
2021/0005378 A1* 1/2021 Hong ..... H01F 41/0206

* cited by examiner

*Primary Examiner* — Michael C Zarroli

(57) ABSTRACT

A transformer is provided which includes an insulating sheet separating the primary-side windings and portion of split magnetic core from the secondary-side windings and portion of split magnetic core. Thin layers of conductive and semi-conductive material are deposited on areas of the insulating sheet surfaces facing the primary and secondary sides. These layers are electrically referenced or tied to the potentials of the respective primary or secondary sides. This ensures that the high electric field due to primary-to-secondary potential gradient is substantially placed across the insulating sheet dielectric and avoided in the air gaps or voids in the transformer, thus reducing undesirable partial discharge effects. The two core sections on the primary and secondary side are also electrically referenced or tied to the potentials of their adjacent windings, thus reducing high electric fields and partial discharge in the space between the core sections and the windings.

10 Claims, 4 Drawing Sheets

TRANSFORMER WITH IMPROVED INSULATION STRUCTURE

CROSS-REFERENCE TO RELATED APPLICATION

This application claims the benefit of U.S. Provisional Patent Application No. 62/964,713, filed 23 Jan. 2020, which is incorporated by reference herein in its entirety.

STATEMENT OF GOVERNMENT INTEREST

Portions of this invention were made with government support under N00014-16-1-2956 awarded by the Office of Naval Research, U.S. Department of the Navy. The government has certain rights in the invention.

BACKGROUND

The present invention relates to the field of electric power and transformers. Specifically, the present invention relates to improved insulation for transformers. More specifically the present invention relates to an improved insulation structure for medium or high frequency transformers that are used to provide compact galvanic isolation and voltage step-up or step-down in power conversion applications.

Transformers are a key component of electric power transmission and distribution systems and provide functions such as step-up or step-down of voltages and galvanic isolation between the input and output sides. They are also extensively used along with power semiconductor devices as a part of switch-mode power supplies in applications such as computer power supplies, adapters and battery chargers. In such switch-mode power supplies, fast-switching transistors convert the incoming line frequency AC which is typically 50 or 60 Hz to a much higher frequency in the tens or hundreds of kHz. This high frequency is then fed through a transformer and rectifier for producing low voltage DC. Generally, high frequency operation instead of line frequency operation reduces the size and weight of the transformer since a smaller magnetic core can be used. This property along with improvements in power semiconductors capable of increased switching frequencies have led to power supplies such as battery wall-chargers becoming more compact. Power conversion using high frequency transformers instead of line frequency transformers can also be extended to higher voltage and power applications such as electric locomotives, wind turbines or industrial motor drives to bring benefits of reduced size and weight. However, for high voltage applications, even though the transformer core and windings can be reduced through the use of higher frequency, the insulating materials and structure used between transformer components such as primary and secondary windings and core often remain sizeable and can become a significant part of the overall transformer weight and size. Oil is often used as an insulating medium due to good dielectric properties, but is not preferred in many applications such as locomotives or ships due to concerns such as flammability or possibility of leaks. In dry-type transformers, materials such as paper, epoxy, fiberglass, Nomex® and Kapton® are used as insulating media instead of oil. Dry-type transformers using insulating materials such as epoxy are susceptible to partial discharge breakdown particularly if there are voids or pockets of air in the dielectric space. They are also generally more difficult to manufacture and costlier than oil-filled transformers for high power applications. In many designs, insulating bobbins or coil-formers are used to separate the primary winding, secondary winding and the core from each other. The use of epoxy encapsulants or bobbins leads to a high thermal barrier for the windings and makes it difficult to cool them. Therefore, what is needed are techniques that overcome the above mentioned disadvantages.

BRIEF SUMMARY OF THE INVENTION

Embodiments of the invention provide a transformer with improved insulation. In particular, the invention provides an improved insulation for medium or high frequency transformers wherein the primary and secondary voltages are in the range of few volts to kilovolts and the isolation required between the primary and secondary sides is in the few kilovolts to tens of kilovolts. Such transformers can be used in concert with power semiconductor switching devices to develop modular power electronic building blocks for power transmission, distribution and processing applications.

In accordance with one aspect of the invention, an insulating sheet is used to separate the primary and secondary sections of the transformers, with the primary winding and a first section of a split magnetic core placed on one side of the insulating sheet and the secondary winding and a second section of the split magnetic core placed on the other side of the insulating sheet. The insulating sheet can be made, for example, of material with high dielectric breakdown strength such as mica, ceramics or glass. A thin conductive or semiconductive layer is deposited on the two sides of the insulating sheet. Each of the primary and secondary-side conductive or semiconductive layer is electrically connected or referenced to a potential of its respective winding. This ensures that the isolation stress, i.e., the potential between the primary and the secondary sides is substantially impressed across the insulating sheet and any potential gradients across air gaps or voids between the primary and secondary side are minimized thus reducing the possibility of partial discharge or corona.

According to another aspect of the invention, portions of the afore-mentioned primary and secondary-side conductive or semiconductive layers can be in the form of thin lines instead of a continuous layer to reduce eddy current losses in the presence of changing magnetic fields of the transformer.

According to another aspect of the invention, portions of the afore-mentioned primary and secondary-side conductive or semiconductive layers can have discontinuities or slots in them to inhibit the formation of shorted conductive turns that can result in eddy current losses in the presence of varying magnetic fields of the transformer.

According to yet another aspect of the invention, the transformer core section adjacent to the primary winding is electrically connected or referenced to a potential of the primary side winding, and similarly the transformer core section adjacent to the secondary winding is electrically connected or referenced to a potential of the secondary side winding. This allows the two split portions of the core to be referenced to their nearby windings, this reducing voltage gradients and partial discharge possibility in the spaces adjacent to the legs of the two core sections.

Various other features and advantages will be made apparent from the following detailed description and the drawings.

BRIEF DESCRIPTION OF THE DRAWINGS

The present invention is illustrated by way of example and not limitation in the figures of the accompanying drawings in which like references indicate similar elements.

DETAILED DESCRIPTION

Various embodiments and aspects of the invention will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Reference in the specification to "one embodiment" or "an embodiment" or "another embodiment" means that a particular feature, structure, or characteristic described in conjunction with the embodiment can be included in at least one embodiment of the invention.

Figure 1A:
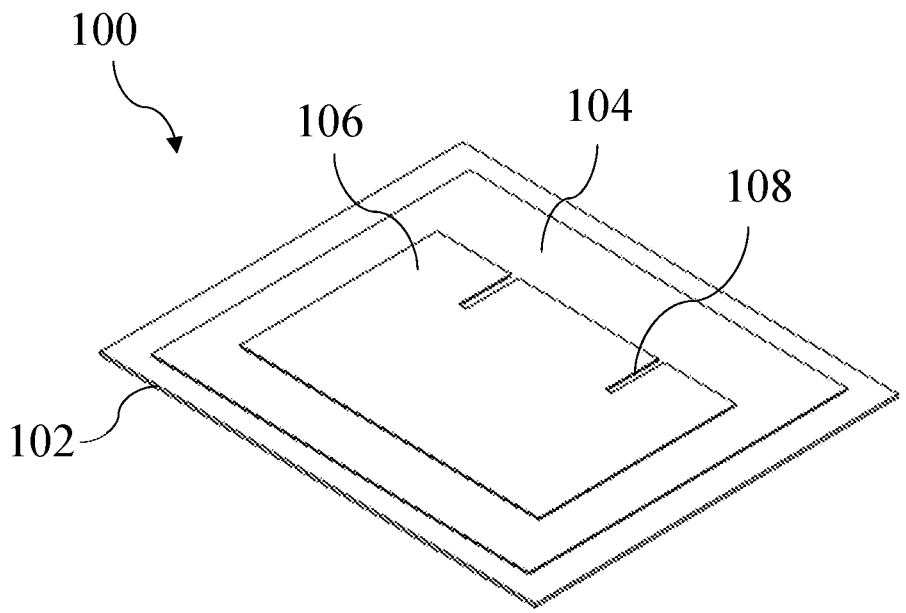
FIG. 1A illustrates an insulating sheet with semiconductive or conductive layers added on portions of the surfaces of the insulating sheet, according to one embodiment of the present invention. The insulating sheet is used to provide dielectric strength and the conductive or semiconductive layers are used to control voltage stress grading in the transformer. The conductive or semiconductive layer on the insulating sheet can be in the form of a continuous layer or in the form of thin lines to reduce eddy current losses.

FIG. 1A illustrates an insulation structure, 100, for a transformer with improved insulation according to an embodiment of the present invention. The structure contains an insulating sheet 102 made of material with a high dielectric breakdown strength, such as mica, ceramic or glass. The thickness of the sheet is chosen such that it can withstand the potential difference imposed across the primary and secondary sides during nominal and transient operating conditions. In addition, the sheet should be sufficiently thin to meet the primary and secondary coupling as well as leakage and magnetizing inductance parameters desired in the application. As an example, about 50 mil mica sheet thickness may be appropriate for a system requiring 10 kilovolts primary-secondary nominal isolation voltage. An electrically conductive or semiconductive layer, 106, is deposited on the insulating sheet 102 in the central area where the transformer primary coils and primary side of the split core are to be placed. The electrically conductive layer can be achieved with, for example, a thin 1 mil coating of MG Chemicals® 838AR carbon spray paint that has a conductivity of about 110 ohms/square at that thickness. A material of lower conductivity can be used if eddy current losses need to be reduced with the choice being made based on frequency and intensity of magnetic field in the transformer. The layer 106 can have slots such as 108 to prevent a continuous path for eddy currents that may arise due to the varying magnetic fields in the transformer. Outside the region 106, a layer, 104, of semiconductive material is deposited on the insulating sheet extending towards the periphery. Examples of such semiconductive material include Glyptal® GE 9921 paint with a conductivity in the range of 3,000-32,000 ohms/square. This layer is used to control the voltage stress distribution between the central portion of the insulating sheet, where the transformer primary-side coils and split-core portion are placed, and the periphery of the sheet, where there may be ground-referenced objects such as the frame or housing of the equipment. The layers 106 and 104 have been depicted as rectangular in the illustration, but can instead have rounded corners to reduce electric field intensities.

Figure 1B:
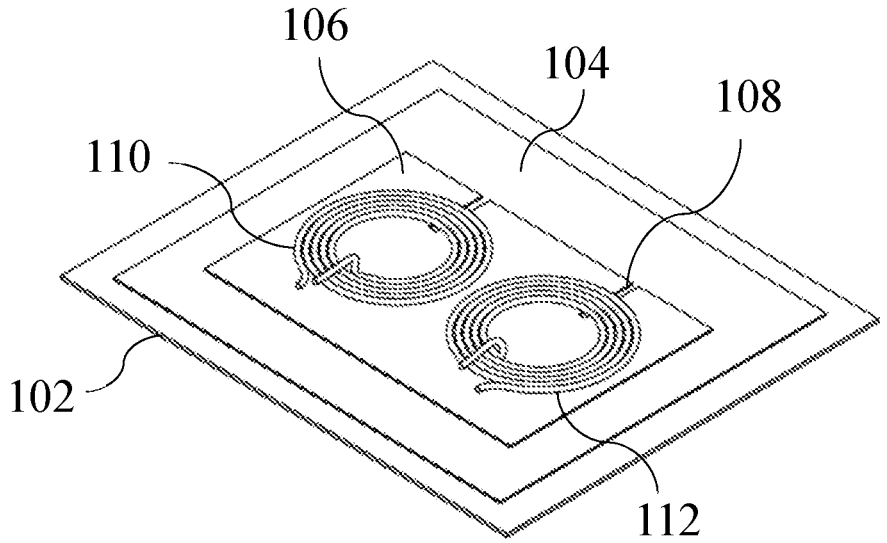
FIG. 1B illustrates a set of two coils added on the top side of the insulating sheet. The two coils can be paralleled, or seriesed to form the primary winding or can be independently connected to loads, sources or power processing and distributing components. Another set of two coils, not visible in the illustration, are placed on the bottom side of the insulating sheet to form the secondary side winding.

FIG. 1B illustrates a further step in the construction of the transformer according to an embodiment of the present invention. Two coils, 110 and 112, are placed on the top side of the insulating sheet 102. These coils can be connected in series or parallel and constitute the primary-side windings of the transformer. In a similar fashion, although not visible in FIG. 1*b*, the bottom side of the insulating sheet, 102, has conductive and semiconductive layers deposited on its surface and coils are placed on it to form the secondary-side windings. The coils are illustrated as planar coils resting on the two sides of the sheet, but can be elevated from the sheet, for example, to increase the leakage inductance of the transformer by having greater spatial separation between the primary and secondary coils.

Figure 2:
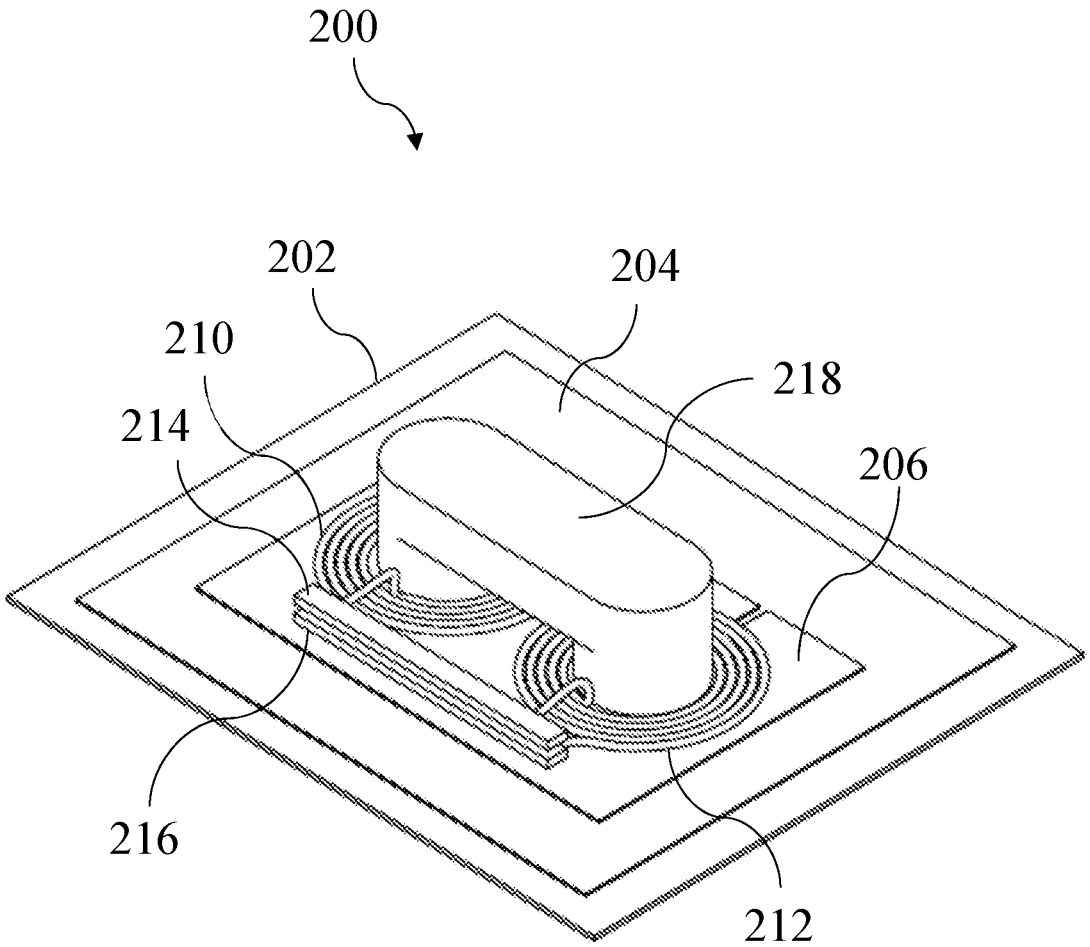
FIG. 2 illustrates the primary-side portion of the split transformer core along with primary-side windings and terminals placed on the top side of the insulating sheet with semiconductive or conductive layers on the top surface, according to one embodiment of the present invention.

FIG. 2 illustrates a further step in the construction of the transformer, 200, according to an embodiment of the present invention. An isometric view of the primary side is shown. As described earlier, the insulating sheet, 202, has a conductive or semiconductive layer, 206, deposited on the surface in the central region, and a semiconductive layer 204 deposited on the surface between the region 206 and the periphery of sheet 202. Coils 210 and 212 are paralleled and connected to terminals 214 and 216 which serve as the primary winding connections. The conductive layer 206 is tied to a potential of the primary coils, for example by electrically connecting/referencing the layer 206 to the terminal 216. A section of the split magnetic core, 218, consisting of soft magnetic material such as ferrites, powdered iron, etc., is placed on top of the sheet 202 and layer 206 in a position to couple it with the coils 210 and 212. The core section 218 is electrically referenced to the primary side coils, for example, through contact of the core legs with the conductive layer 206 or through a dedicated electrical connection. Although two primary side coils and a core with two legs coupled to the coils is shown in the embodiment here, other variations such as an E-core or pot-core with a central leg coupled to one primary coil can be also constructed according to the insulation method described in this invention. A mirror image of the elements that have been described above for the primary side of the transformer are placed on the bottom side of the insulating sheet to form the secondary side of the transformer as illustrated in the next figure.

Figure 3:
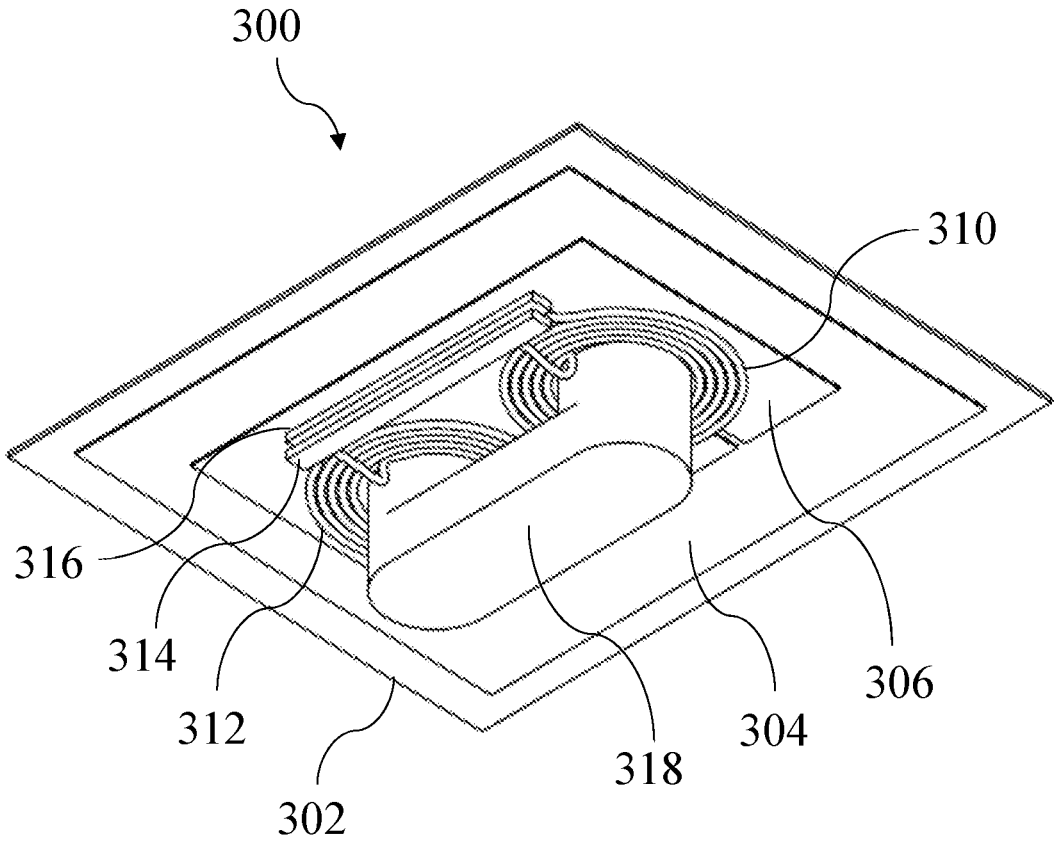
FIG. 3 illustrates the secondary-side portion of the split transformer core along with secondary-side windings and terminals placed on the bottom side of the insulating sheet with semiconductive or conductive layers on the bottom surface, according to one embodiment of the present invention.

FIG. 3 illustrates the secondary side of the transformer, 300. The secondary side is constructed on the bottom side of the insulating sheet 302. In a similar fashion to the primary side construction, a conductive or semiconductive layer, 306, is deposited or spray-painted on the central surface area, and a semiconductive layer, 304 is deposited on the area surrounding the layer 306 towards the periphery of the insulating sheet 302. Coils 310 and 312 are placed on the bottom side of the insulating sheet and connected to terminals 314 and 316 which form the secondary terminals. The conductive layer 306 is tied to a potential of the secondary coils, for example by electrically connecting/referencing the layer 306 to the terminal 316. A section, 318, of the split magnetic core abuts the bottom side of the insulating sheet so as to couple to the secondary coils 310 and 312. The core section 318 is electrically referenced to the secondary side coils, for example, through contact of the core legs with the conductive layer 306 or through a dedicated electrical connection. The insulating sheet, 300, thus separates the primary and secondary-side sections of the split core and windings and provides galvanic isolation between the two sides. The secondary-side electrically-tied conductive layer, 306, and the primary-side electrically-tied conductive layer, 206, ensure that the potential difference between the primary and secondary sides is substantially impressed across the insulating sheet material and any voltage gradients are substantially avoided in the air or voids surrounding the coils and core. This reduces partial discharge occurrence or corona that can degrade the life of the transformer. The semiconducting layers on the two sides of the insulating sheet control the voltage stress distribution on the two sides between the coils and the periphery of the sheet.

Figure 4A:
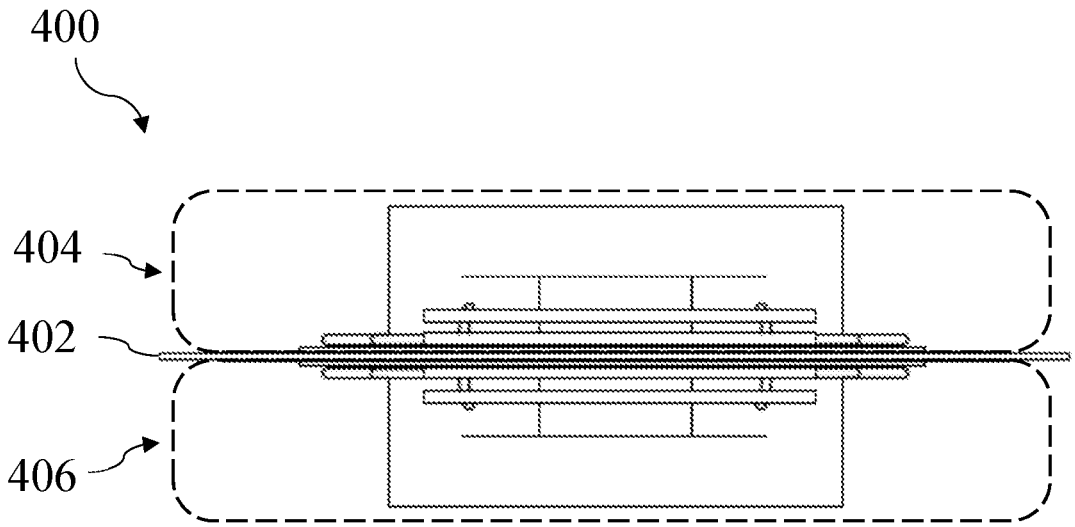
FIG. 4A illustrates a front view of the transformer showing the insulating sheet with conductive/semiconductive layers on portions of the top and bottom surfaces of the sheet and primary and secondary windings and split-core sections placed on the two sides of the insulating sheet according to one embodiment of the present invention.

FIG. 4A shows a front view of the transformer, 400, according to the previously described embodiment of the invention, with 402 being the insulating sheet that partitions the transformer coils and core into a primary section, 404, and a secondary section, 406, and provides galvanic isolation between them.

Figure 4B:
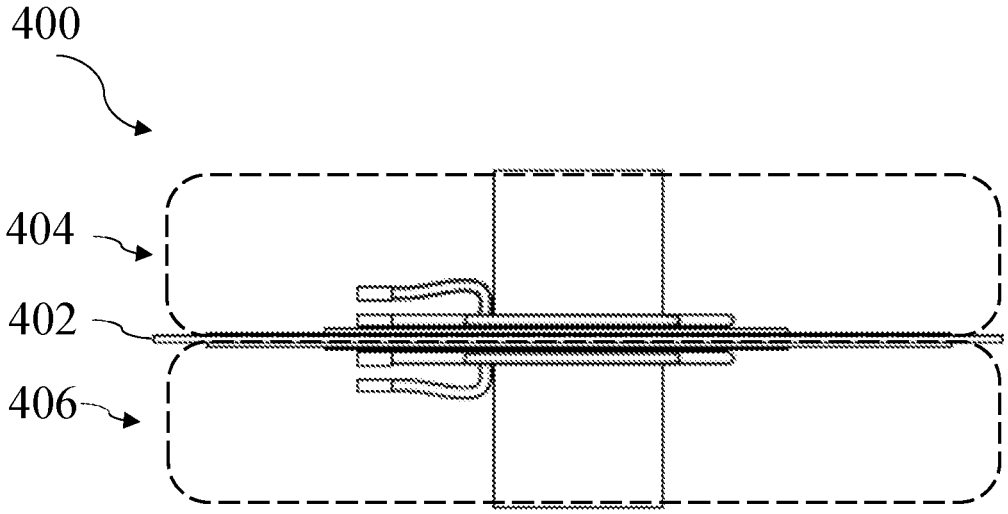
FIG. 4B illustrates a side view of the transformer showing the insulating sheet with conductive/semiconductive layers on portions of the top and bottom surfaces of the sheet and primary and secondary windings and split-core sections placed on the two sides of the insulating sheet according to one embodiment of the present invention.

FIG. 4B shows a side view of the transformer, 400, according to the previously described embodiment of the invention, with 402 being the insulating sheet that partitions the transformer coils and core into a primary section, 404, and a secondary section, 406, and provides galvanic isolation between them.

The foregoing description of exemplary embodiments of the invention has been presented for the purposes of illustration and description. It is not intended to be exhaustive or to limit the invention to the precise forms disclosed. It will be recognized by those skilled in the art that many modifications and variations are possible without departing from the essential scope of the invention. It is, therefore, to be understood that the scope of the invention is not limited to the particular embodiments disclosed, and that the invention will include all embodiments falling within the scope of the claims appended hereto.

What is claimed is:

1. A transformer comprising:

a primary winding;

a secondary winding;

a core, said core being split into a primary-side core portion and a secondary-side core portion; and an insulating sheet;

wherein said primary winding and said primary-side core portion are placed on a first side of said insulating sheet, and said secondary winding and said secondary-side core portion are placed on a second side of the said insulating sheet;

wherein the surface of the insulating sheet on the side in which the primary winding and the primary-side core portion are placed has a conductive or semiconductive coating on at least a first portion of said surface, and wherein the said surface has a semiconductive coating on a second portion extending from the boundary of the said first portion toward a periphery of the said surface to control the voltage gradient between said first portion and said periphery.

2. The transformer of claim 1 wherein the primary-side core portion is electrically tied to a potential of the primary winding, such that the potential gradient between the primary-side core and the primary winding is substantially reduced.

3. The transformer of claim 1 wherein the secondary-side core portion is electrically tied to a potential of the secondary winding, such that the potential gradient between the secondary-side core and the secondary winding is substantially reduced.

4. The transformer of claim 1 wherein the said conductive or semiconductive coating on said first portion is electrically tied to a potential of the primary winding.

5. The transformer of claim 4 wherein said conductive or semiconductive coatings consist of a continuous layer or of thin lines or stripes to reduce eddy current losses.

6. The transformer of claim 4 wherein said conductive or semiconductive coatings have a discontinuity to prevent the formation of a shorted turn path for induced currents.

7. The transformer of claim 1 wherein the surface of the insulating sheet on the side in which the secondary winding and the secondary-side core portion are placed has a conductive or semiconductive coating on at least a portion of said surface, and wherein the said conductive or semiconductive coating is electrically tied to a potential of the secondary winding.

8. The transformer of claim 7 wherein said conductive or semiconductive coatings consist of a continuous layer or of thin lines or stripes to reduce eddy current losses.

9. The transformer of claim 7 wherein said conductive or semiconductive coatings have a discontinuity to prevent the formation of a shorted turn path for induced currents.

10. The transformer of claim 1 wherein the surface of the insulating sheet on the side in which the secondary winding and the secondary-side core portion are placed has a conductive or semiconductive coating on at least a first portion of said surface, and wherein the said surface has a semiconductive coating on a second portion extending from the boundary of the said first portion toward a periphery of said surface to control the voltage gradient between said first portion and said periphery.

* * * * *